US012150535B2

(12) United States Patent
Corra et al.

(10) Patent No.: US 12,150,535 B2
(45) Date of Patent: Nov. 26, 2024

(54) HAIR STYLING DEVICE IMPARTING AN UPDO HAIRSTYLE WHEN WORN AND A DIFFERENT CURLED OR STRAIGHTENED HAIRSTYLE WHEN REMOVED

(71) Applicants: Emily Corra, Lawrencetown (CA); Richard Edward Connolly, Halifax (CA)

(72) Inventors: Emily Corra, Lawrencetown (CA); Richard Edward Connolly, Halifax (CA)

( * ) Notice: Subject to any disclaimer, the term of this patent is extended or adjusted under 35 U.S.C. 154(b) by 0 days.

(21) Appl. No.: 17/408,874

(22) Filed: Aug. 23, 2021

(65) Prior Publication Data

US 2023/0057913 A1 Feb. 23, 2023

(51) Int. Cl.

| | |
|---|---|
| ***A45D 2/12*** | (2006.01) |
| ***A45D 8/36*** | (2006.01) |
| ***A45D 8/38*** | (2006.01) |
| *A44C 15/00* | (2006.01) |
| *A45D 2/00* | (2006.01) |
| *A45D 7/00* | (2006.01) |
| *A45D 8/00* | (2006.01) |

(52) U.S. Cl.

CPC ..... *A45D 2/12* (2013.01); *A45D 8/36* (2013.01); *A45D 8/38* (2013.01); *A44C 15/006* (2013.01); *A45D 2002/007* (2013.01); *A45D 2007/004* (2013.01); *A45D 8/004* (2021.01)

(58) Field of Classification Search

CPC . A45D 8/38; A45D 8/36; A45D 8/004; A45D 2007/004; A45D 2002/007; A45D 2/362; A45D 2/10; A45D 2/12; A44C 15/006

USPC ..... 132/55, 274

See application file for complete search history.

(56) References Cited

U.S. PATENT DOCUMENTS 2,308,819 A * 1/1943 Mcfadden ..... A45D 8/38 132/223

3,343,549 A * 9/1967 Weitzner ..... A45D 2/10 132/251

(Continued)

FOREIGN PATENT DOCUMENTS

KR 200373101 * 1/2005

OTHER PUBLICATIONS

Mya Acoustics. "DIY How to make fabric beads neck chain in tamil". YouTube, uploaded by Mya Acoustics, May 25, 2020. https://www.youtube.com/watch?v=Gbu9uJep0FU. (Year: 2020).*

*Primary Examiner* — Nicholas D Lucchesi

*Assistant Examiner* — Jennifer Gill

(74) *Attorney, Agent, or Firm* — Kyle R Satterthwaite; Ryan W Depuis; Ade & Company Inc

(57) ABSTRACT

A hair styling device features a headband worn along a hairline of a user's head and spanning around a crown thereof, preferably with an ornamental appearance displayed on a front portion of the headband across the along a front hairline to enable daytime wearing thereof in social settings. A rear portion of the headband is embodied by a bobble strand comprising a series of ball-shaped bobbles sequentially arranged therealong to span in series across the back of the users head, where the user's hair is able to be wrapped around said bobble strand at a rear of the hairline. This wound state of the user's hair around the said strand of bobbles imparts a curling action that leaves behind a curled hairstyle on the user's hair when the headband is removed.

18 Claims, 5 Drawing Sheets

(56) References Cited

U.S. PATENT DOCUMENTS

| | | | | |
|---|---|---|---|---|
| 6,076,532 | A * | 6/2000 | Thomas | A45D 8/36 132/273 |
| 6,425,404 | B1 * | 7/2002 | Quevedo | A45D 2/24 132/246 |
| 6,708,698 | B2 * | 3/2004 | Catini | A45D 2/14 132/250 |
| 6,923,285 | B1 * | 8/2005 | Rossow | E02F 3/431 701/50 |
| 7,125,417 | B2 * | 10/2006 | Mizrahi | A61K 36/899 607/114 |
| 2004/0069316 | A1 * | 4/2004 | Kraus | A45D 2/14 132/268 |
| 2010/0175709 | A1 * | 7/2010 | Hsu | A45D 8/36 132/275 |
| 2015/0250280 | A1 * | 9/2015 | Van Der Veur | A45D 7/02 132/229 |
| 2015/0335123 | A1 * | 11/2015 | Chen | A45D 8/36 132/273 |
| 2019/0133288 | A1 * | 5/2019 | Corra | A45D 2/122 |

* cited by examiner

110'

HAIR STYLING DEVICE IMPARTING AN UPDO HAIRSTYLE WHEN WORN AND A DIFFERENT CURLED OR STRAIGHTENED HAIRSTYLE WHEN REMOVED

FIELD OF THE INVENTION

The present invention relates generally to hair accessories and hair styling devices, and more particularly to a unique device wearable in social settings to maintain an updo hairstyle, while imparting a styling action on the hair to leave a different hairstyle result in the user's hair once the device is removed.

BACKGROUND

Hair extensions are commonly used to add a unique look to a person's natural hair that differs in design, volume and thickness.

In addition, people with straight hair that want to change their hair's texture by forming curls or waves have conventionally relied on a curling iron, flat iron or other hot tool accessory, thereby imparting heat damage from such tools which essentially burn the hair into place. Prolonged exposure to hot tools causes hair to break off. These hot tools are not recommended for daily use as the damage to the person's natural hair is too severe, causing breakage split ends discoloration and, at times, even melting.

Professionals agree it is of paramount importance, to limit use of hot tools or accessories. Temperatures of hot tool devices can reach 450° F., and are most commonly set at 330-350° F. and up, which is literally destructive to natural human hair. These hot temperatures, applied to skin, would be instantaneously destructive. First degree burns start at 118° F., and at 162° F. human tissue is instantly destroyed on contact, yet people that want curls or waves expose their hair to 300 F every time they want to re-curl their hair.

Other methods include changing straight hair into curls by the use of chemical perms, which cause damage by breaking the hair's bonds apart, and re-forming the bonds into the shape of the curl. Both curling methods cause excessive damage, and with exposure cause burnt hair, broken hair, melted hair, split ends and hair discoloration. The chemical perm method is also limited, as the user must grow their hair out for several months, before undergoing another perm. Hair already chemically damaged from the prior treatment is impossible to avoid when reapplying the next perm, which often leads to severed, broken hair.

Accordingly, there has arisen a desire for a completely safe, non-damaging method to create wavy or curly hair in a healthy way.

In one type of prior art solution, a curled or wavy look is imparted to a head of sufficiently long hair by donning a foam-filled headband or similar appliance in the evening, wrapping the hair in coiled fashion around the headband, and leaving the appliance and wrapped hair in place overnight during one's sleep, whereby the coiled condition of the hair around the headband imparts a curling action thereon, thus leaving behind a wavy/curled hairstyle when the appliance is removed in the morning. Commercially available products of this type include the Aurora Band Night Roller by Aurora Hair Products, as seen at http://www.aurorahairproducts.com/, and the GlamWaves Heatless Roller Band by UK Innovations GP Ltd., as seen at https://innovatestore.co.uk/.

While providing a useful alternative to curling irons and heated rollers whose high-heat metal-to-hair contact can be damaging, these headband products are unsightly during use, and thus are used as "overnight" hairstyling appliances, whereby the appliance can be left in for a sufficiently long period to achieve the desired styling effect, without the user worrying about embarrassment of wearing the unsightly appliance outside the privacy of their home.

Applicant, in prior patent application US2019/0133288, the entirety of which is incorporated here by reference, disclosed a wearable hairstyling appliance or device that imparts a similar curling action to the hair, yet is usable in a stylistic manner enabling the user to wear it out in social settings, owing to the incorporation of a natural or synthetic hair braid, jewelry chain, or other ornamental feature across the front of the band.

However, there remains room for improvement, and Applicant has since developed a novel redesign of their wearable hairstyling appliance with further improvements and benefits over the earlier design from said prior application.

SUMMARY OF THE INVENTION

According to one aspect of the invention, there is provided a hair styling device comprising:

a headband wearable in a working position lying along a hairline of a user's head to span around a crown of the user's head with a front portion of the headband spanning generally across a forehead of the user's head and a rear portion of the headband spanning across a back of the user's head behind the ears thereof;

the rear portion of the headband comprising a bobble strand comprising a series of ball-shaped bobbles of three dimensionally convex curvature sequentially arranged along said strand, in an axial direction thereof denoted by a strand axis penetrating through said ball-shaped bobbles, in alternating fashion to a series of reduced-diameter necks that are interspersed between said ball-shaped bobbles in said axial direction and are also of three dimensionally convex curvature and penetrated by said strand axis, but are of lesser diameter, measured radially of said strand axis, than said ball-shaped bobbles, whereby the alternating ball-shaped bobbles and reduced diameter necks are wearable to span in series across the back of the user's head, where the user's hair is able to be wrapped around the three-dimensionally convex curvature of both said ball-shaped bobbles and said reduced-diameter necks at a rear of the hairline to impart a curling action that leaves behind a curled hairstyle on the user's hair when the headband is removed;

wherein the three dimensionally convex curvature of the ball-shaped bobbles and the reduced-diameter necks includes both a rounded convexity of each ball-shaped bobble and each reduced-diameter neck in a circumferential direction around said strand axis, and an arcuate convexity of each ball-shaped bobble and each reduced-diameter neck in the axial direction along said strand axis, and said rounded convexity possessed by each ball-shaped bobble and each reduced-diameter neck in the circumferential direction spans a full 360-degrees around said strand axis.

In a disclosed embodiment, the arcuate convexity of each reduced-diameter neck in the axial direction intersects with the arcuate convexity of a neighboring two of the ball-shaped bobbles where said reduced-diameter neck joins said neighboring two of the ball-shaped bobbles.

In a disclosed embodiment, each reduced-diameter neck is externally ovoid in shape, each reduced-diameter neck is greater in axial length than in diameter, and the arcuate curvature of each reduced-diameter neck in the axial direction has a non-uniform radius of curvature.

In a disclosed embodiment, each ball-shaped bobble is externally spherical in shape, and the arcuate curvature of each reduced-diameter neck in the axial direction has a uniform radius of curvature.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 1A:
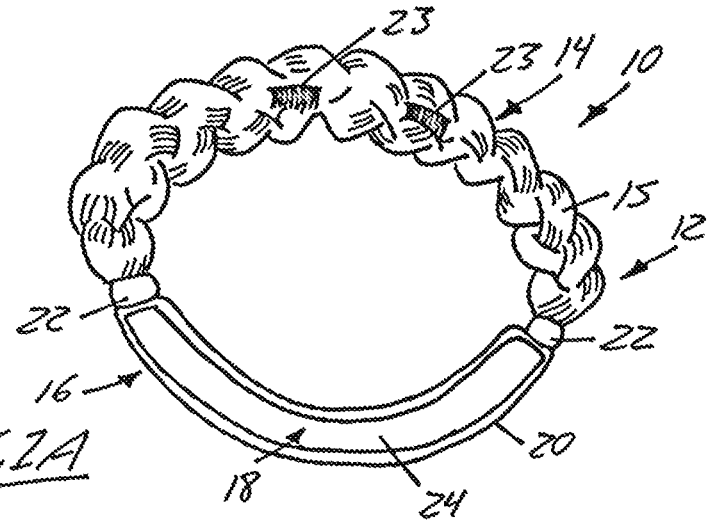
FIGS. 1A, 1B and 1C are plan views of prior art hairstyling headbands from Applicant's aforementioned prior application.
Figure 1B:
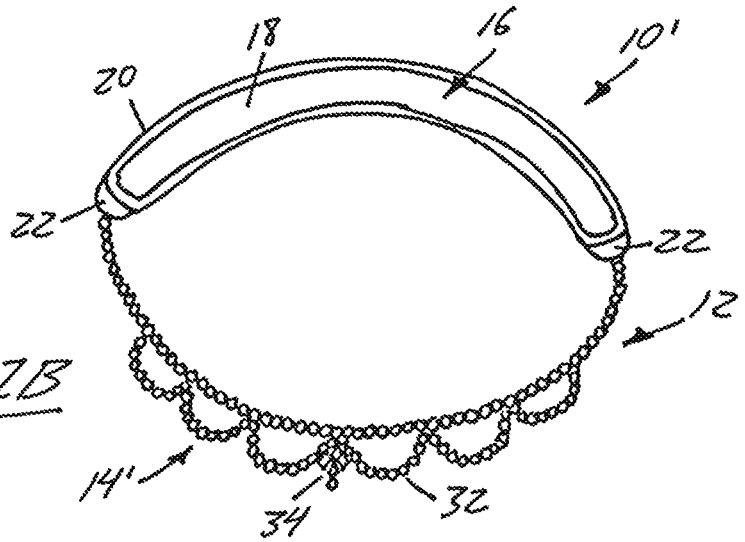
Figure 1C:
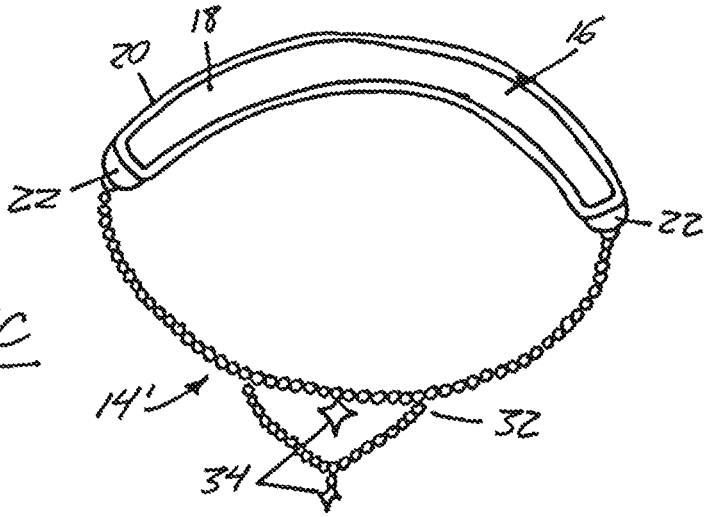

FIGS. 1A through 1C show prior art wearable hairstyling devices 10, 10', 10" each in the form of a closed loop stretchable headband 12 configured to fit securely on the wearer's head in a working position spanning circumferentially around the crown of the wearer's head in a manner generally following the wearer's hairline. In the FIG. 1A example, a front half 14 of the headband features a cluster of hair 15 tied into a braided pattern for wearing on the user's forehead in a position lying thereacross over the front of the user's hairline. The hair used on the device may be real human hair, or synthetic hair. Whether real or synthetic, this hair of the device may be referred to herein as auxiliary hair in order to distinguish it from the user's natural hair. FIGS. 1B and 1C show variants of the prior art headband, where the ornamental function of the front half 14' of the headband is provided by one or more jewelry chains 32, and optional jewels 34, instead of an auxiliary hair braid. As another ornamental alternative to braids, chains or other strung jewelry at the front half of the headband, a simple band of fabric may span between the two ends of the rear tubular cover at the front of headband, and may carry one or more gems thereon, and/or have a printed or natural ornamental pattern thereon. This ornamental band may be resiliently stretchable, and thus contribute to the self-fitting self-securing resiliency of the overall headband, or may be made of a non-stretchable fabric. Cotton and spandex are just two examples of a larger variety of fabrics that may be employed for use in a jeweled, non-jeweled, printed or naturally patterned fabric band at the ornamental front half of the headband.

A rear half of the headband 16 features an elongated flexible insert 18 that has a circular cylindrical shape, is made of or contains moisture-absorbing material (e.g. foam), and is encapsulated within a tubular cover 20 whose opposite ends are respectively coupled to the two ends of the front hair braid 14 at connections 22 so that the tubular rear cover 20 and the front hair braid 14 collectively define the closed-loop shape of the overall headband 12. In FIGS. 1A through 1C, the tubular cover 20 is transparent or translucent in order to visually reveal the insert 18 placed within the hollow interior of the cover, but it will be appreciated from the described use of the device that the tubular cover need not be transparent, and can be made of an opaque material. The selected fabric of the tubular cover 20 is resiliently stretchable, at least in the longitudinal/axial direction of its elongated tubular shape spanning the respective half of the closed loop of the overall headband. This longitudinal stretchability of the rear half of the headband enables enlargement of the overall closed-loop shape of the headband to allow the headband to stretch over the top of the user's head into the working position spanning around the crown of the head at hairline level, whereupon the resiliency of the rear tubular cover 20 will self-tighten the headband 12 into secured circumferential relation to the user's head.

Referring to FIG. 1A, hair extension clips 23 are sewn to the front hair braid 14 to enablement attachment of the hair braid to the user's hair along the front hair line with the hair extension clips 23. Together with the tension of the stretched rear half of the headband, these clips 23 help keep the braid in place and prevent the braid from slipping off of user's head. In the prior art devices of FIGS. 1 to 3, the tubular cover 20 features an open or openable slit or access hole 20*a* in one side of the tubular cover near one end thereof to enable insertion and withdrawal of the insert 18 thereto and therefrom. The circular cylindrical shape of the insert imparts a circular cylindrical shape to the tubular cover when inserted therein, whereby the resulting circular cylindrical shape of the overall rear half of the headband creates an effective hair roller around which the user's natural hair can be wound.

Figure 2:
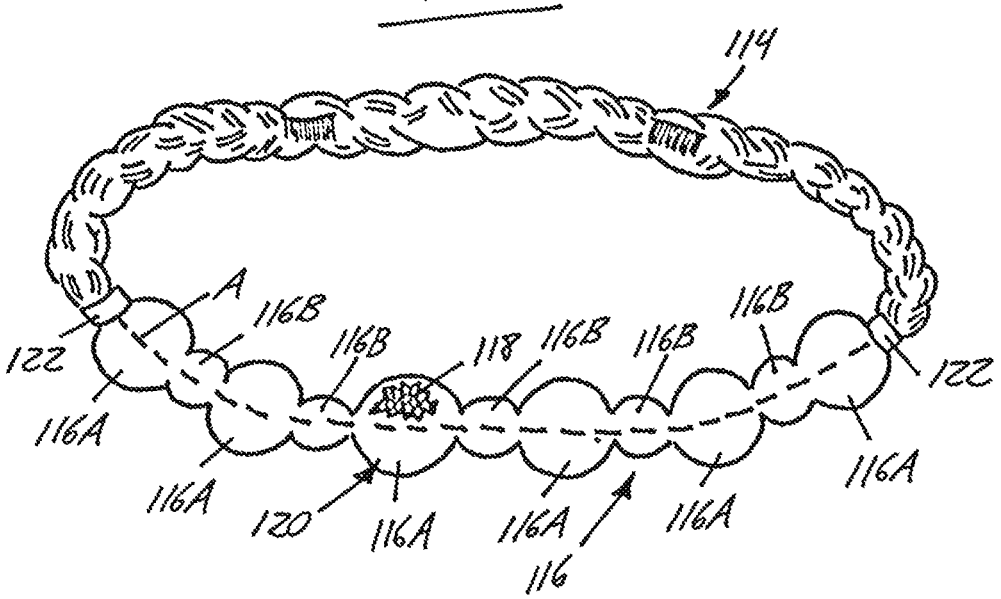
FIG. 2 illustrates an embodiment of an improved hairstyling headband of the present invention, a rear half of which is configured as a strand of ball-shaped bobbles for an improved hair curling action.
Figure 3:
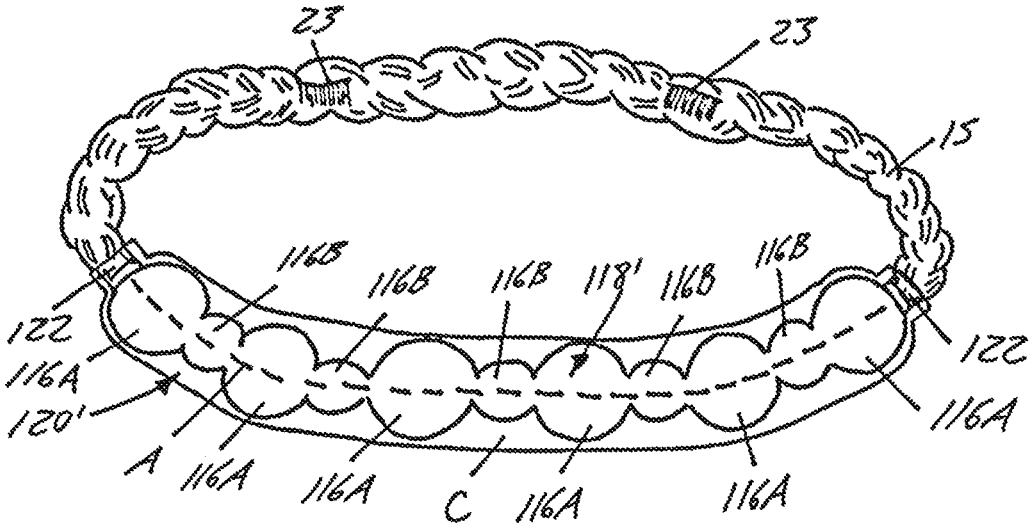
FIG. 3 illustrates an alternate embodiment of the hairstyling headband of FIG. 2.
Figure 4:
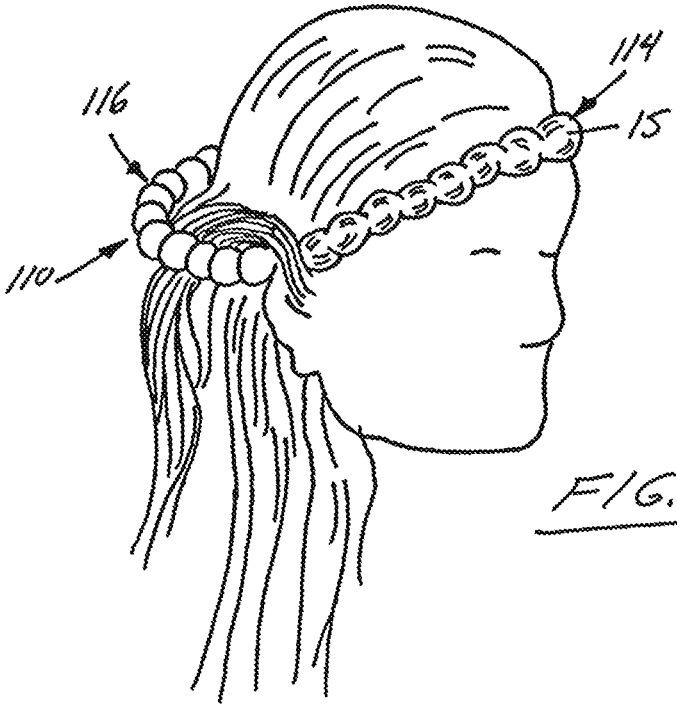
FIG. 4 illustrates wrapping of the user's hair around the rear half of the hairstyling headband of FIG. 2.

The prior art devices shown in FIGS. 1A through 1C, and the embodiments of the present invention described further below with reference to FIGS. 2, 3 and 7, are used in the manner illustrated in FIG. 4. With the insert 18 situated inside the tubular cover 20 at the rear half 16 of the headband, the user slips the headband 12 downwardly into place over the crown of the head until the front braid 14 resides generally of the front hairline at the top of the forehead and spans from an area just over or behind one ear to the matching area over/behind the other ear, and the rear half 16 of the headband spans around the back of head between the user's ears at roughly hairline level. In this working position of the headband, the user's hair naturally hangs downward from behind the headband. One tuft a time, this naturally hanging hair is wrapped upwardly and externally over the rear half 16 of the headband 12, and back down the inside of the headband between the rear cover 20 and the user's head. This wrapping of the hair tuft may be made easier by pulling the roller-defining rear half 16 of the headband away from the user's head to open up a space between the headband and the user's head. The hair tuft is repeatedly wrapped around the roller-defining rear half 16 of the headband in this manner, until the full length of the hair tuft is coiled around the rear half of the headband. This process is repeated tuft-by-tuft, from a first tuft of natural hair at one temple, and around the back of the head to the other temple, until all the natural hair has been wrapped around the roller-defining rear half 16 of the headband.

Figure 5:
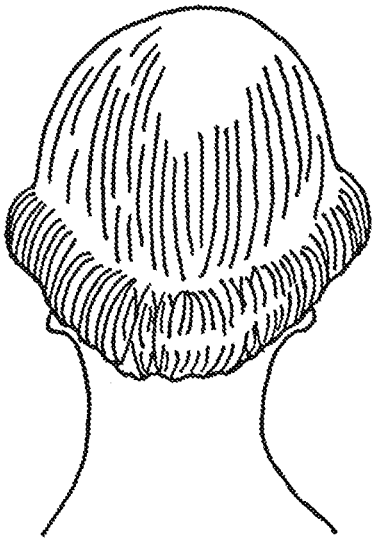
FIG. 5 is a rear view of the worn headband of FIG. 4 with the hair of the user fully wrapped around the roller-like rear half of the headband along the rear hairline at the back of the user's head to create an updo hairstyle.
Figure 6:
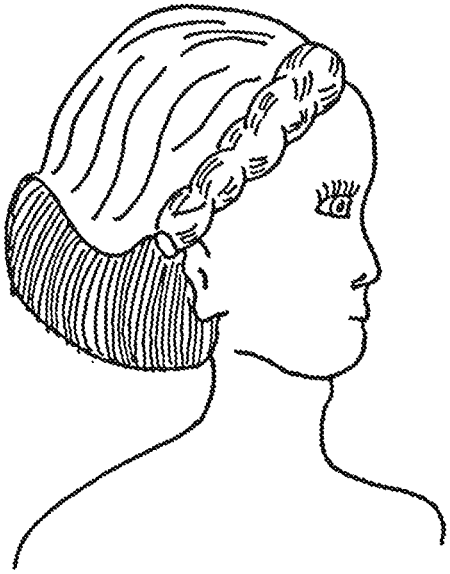
FIG. 6 is a side view of the worn headband of FIG. 5 illustrating how the updo-styled hair wrapped around the roller-like rear half of the headband cooperates with the braided front half of the headband to create a stylistic halo or ring-like appearance around the crown of the user's head.

The finished result is shown in FIGS. 5 and 6, where the coiled tufts of hair tightly wound around the rear half of the headband create a unique updo hairstyle in which a pronounced rim of coiled hair extends along the rear hair line from one ear to the other. From each end of this rim of coiled natural hair at the rear and sides of the head, the front hair braid 14 spanning across the front hairlines creates a continued extension of this rim, whereby the coiled natural hair and braided auxiliary hair create a full ring or halo aesthetic spanning around the entirety of the user's head. The rear half 16 of the headband is entirely concealed from sight by the natural hair wound therearound, and the front braid 14 provides an ornamental appearance across the front hair line that compliments and accentuates the updo style of the wearer's natural hair, as maintained by the roller-defining rear half 16 of the headband.

When worn for a sufficient length of time by a user having naturally straight hair, later removal of the headband will inherently leave curls or waves in the areas of the user's natural air that were wound tightly around the rear half 16 of the headband 12. In other words, at the rear half 16 of the headband, the tubular cover 20 and the insert 18 received therein effectively define a purposeful curl-imparting rear portion of the headband that conformingly spans around the back of the user's head from one ear to the other in order to impart a curling action on the natural hair wound around this rear portion. So while the headband serves as a curl/wave imparting hairstyle appliance leaving behind a curled/wavy hairstyle after removal, it also has an entirely unique ornamental mode of operation serving to achieve and maintain a unique updo hairstyle while worn. Accordingly, the device is not limited to "overnight" applications, as it can be worn out of the house for any number of different outings, including special events or other social settings where the desire for a stylistic appearance is fulfilled by the unique updo achieved by the worn use of the device.

For optimal results, before winding the user's natural hair around the rear portion of the headband, the user's natural hair is first pre-dampened by spraying/misting thereof with water, a water-based spray primer or other suitable hair product. The natural hair is then rolled around the rear half 16 of the headband, and set. Once the natural hair is wound on the headband, it is the drying process of hair from damp to dry that sets and forms the wave/curl in the naturally straight hair. In the case of the present embodiment, the drying of the hair is aided by the moisture absorbing material in the insert 18 of the roller-defining rear half 16 of the headband. This moisture absorption is effective on the user's dampened natural hair via the air and moisture permeable materials employed for the tubular cover 20 of the headband 12 and the casing 24 of the removable insert 18. This process, damp-to-dry setting of the natural hair, lasts much longer than any other form of curling hair, and will usually last at least two days, even without application of heat.

Having set out the forgoing context for the present invention, attention is now turned to inventive embodiments of a new wearable hairstyling appliance that is likewise worn in the same headband fashion as Applicant's earlier designs from the prior patent application, but that incorporate novel features for an improved curling action on the user's hair. The illustrated embodiments of the hairstyling appliance 110, 110' in FIGS. 2 and 3 both once again feature a closed-loop headband 112 composed of an ornamental front half 114 for adorning the front hairline in the worn working position of the headband 112, and a purposeful curl-imparting rear half 116 worn across the back of head between the user's ears at roughly hairline level for wrapping of the user's natural hair therearound. The illustrated examples once again use braided auxiliary hair 15 to form the ornamental front half 114, preferably with clips 23 for intermeshing with the user's natural hair to help hold the headband in place, though one or more jewelry chains may once again be used instead of braided auxiliary hair, as illustrated for the prior designs shown in FIGS. 1B-1C.

The present invention illustrated in FIGS. 2 and 3 differs from the prior designs of FIGS. 1A-1C in that the rear half 116, instead of having a substantially uniform diameter of cylindrical or roller-like form, instead is configured as a flexible bobble strand having a set of ball-shaped bobbles 116A arranged in series with one another in a longitudinal/axial direction denoted by reference axis A, i.e. the direction in which the rear half 116 spans the respective half of the closed loop of the overall headband 112 across the back of the user's head when worn. Each bobble 116A has a rounded exterior of convex curvature both in the longitudinal/axial direction, and in a circumferential direction measured around the illustrated axis A. Preferably the radius of curvature of each bobble's exterior is uniform throughout, resulting in a spherically outer shape of each bobble, though there alternatively may be variation in the radius of curvature, for example resulting in an ovoid shape whose length in the axial direction exceed somewhat exceeds width or diameter measured perpendicularly transverse of the axis A.

Between each adjacent pair of bobbles 116A, a reduced transitional neck 116B joins together the adjacent bobbles 116A. Each such neck 116B is of lesser width or diameter than the two bobbles that it interconnects. In the illustrated embodiment, each neck 116B is also of externally concave curvature in both axial and circumferential directions, for example again being spherical or ovoid in its outer shape. As such, each neck 116B in the illustrated embodiments tapers outwardly from its center toward the neighbouring bobbles at its opposing ends. Alternatively, each neck 116B may have a uniform diameter throughout, and thus be cylindrical in shape. As a further alternative, each neck may be externally concave in the axial direction, thus optionally forming a u-shaped trough between the neighbouring bobbles. Regardless of the specific neck shape, each neck 1166 forms a transitional area of the bobble strand that joins together two neighbouring bobbles in the series. The relatively reduced width or diameter of the neck 1166 relative to the two neighbouring bobbles 116A results in a narrower landing area into which the user's natural hair will slip during winding of the natural hair around the strand of bobbles.

In the embodiment shown in FIG. 2, the flexible bobble strand of the headband's rear half 116 is composed of a tubular fabric cover 120 that, instead of having a uniform diameter like the tubular covers 20 in the prior designs from FIGS. 1A-1C, has enlarged bobble areas arranged in alternating series with reduced neck areas of lesser width/diameter that the enlarged bobble areas. This variable diameter cover 120 is filled with a granular material 118 to impart and maintain the exterior three-dimensional shape of the finished bobble strand. At one of the bobbles 116A, the outer cover 120 is partially cut away in FIG. 2 to schematically reveal the granular filler 118 found inside the fabric cover 120.

In one non-limiting example, the granular material filling the tubular fabric cover 120 is oats, which can be warmed before use of the hairstyling appliance by placing the entire headband, or just the rear half 116 thereof if detachable from the front half, in a microwave. The resulting heated state of the oats inside the tubular fabric cover 120 will improve the curling action exerted on the user's natural hair. Oats are just one non-limiting example of a granular water-containing material capable of being warmed in a microwave for this purpose, other examples of which are silica beads, buckwheat seed, and flax seed. The fabric sleeve may made of a breathable porous fabric to allow moisture exchange through the fabric between the granular filler 118 and the user's natural hair when wound around the bobble strand. In a variant of this embodiment, a thermal gel capable of being warmed in the microwave may be used as the internal filler within the tubular sleeve instead of a granular material, provided that the gel is properly encapsulated within a non-porous envelope, whether through selection of a non-porous material for the tubular outer cover 120 itself, or by having the thermal gel encapsulated within a non-porous internal envelope that is received inside the fabric outer cover 120. For example, a gel-filled plastic inner envelope may be used to hold the thermal gel in fully encapsulated fashion, but with a fabric outer cover 120 still installed over this plastic envelope to provide improved tactile character for wear-comfort and hair-wrapping.

Figure 7A:
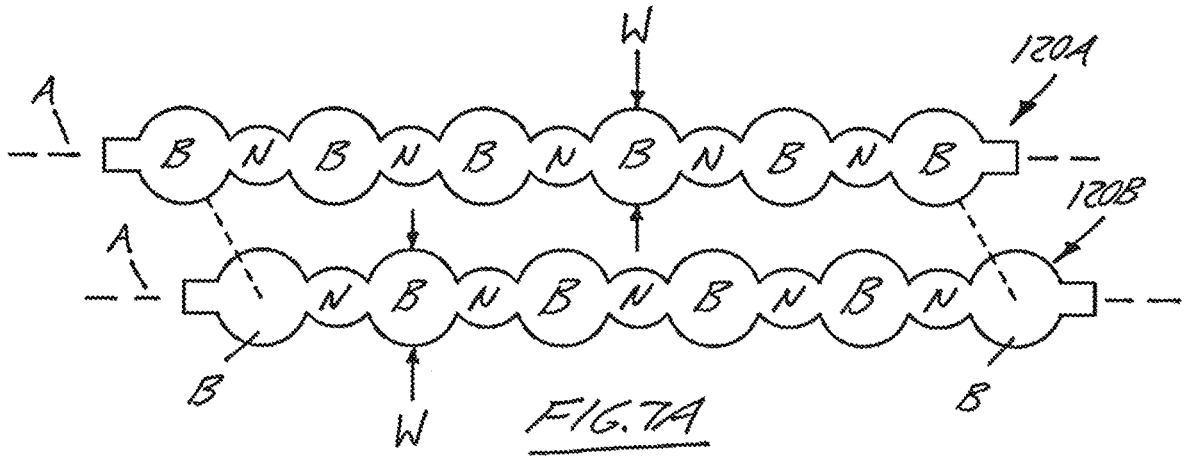
FIG. 7A schematically illustrates assembly of an outer fabric cover for the bobble strand of the hairstyling headband of FIG. 2 using two fabric pieces each cut out in a bobble strand pattern.
Figure 7B:
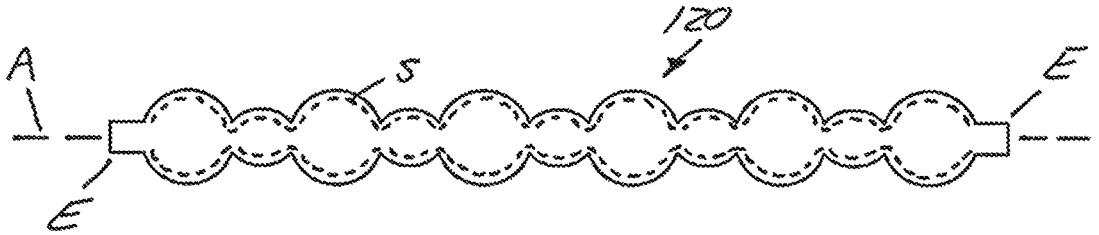
FIG. 7B illustrates the assembled outer fabric cover after stitching together of the two fabric pieces from FIG. 7A.

FIG. 7 illustrates one non-limiting example for construction of the fabric cover 120 of the FIG. 2 embodiment. With reference to FIG. 7A, two separate fabric pieces 120A, 120B, preferably made of stretchable fabric, are each cut in an elongated bobble-strand pattern in which enlarged circular or oval-shaped bobble areas B are interspersed in alternating fashion with reduced neck areas N of lesser width W than the enlarged bobble areas. The neck areas may be of any variety of shape circular, oval, rectangular, etc. The two pieces are laid overtop one another in aligned fashion, and then sewn together along their aligned boundary edges in the axial/longitudinal direction in which their bobble and neck areas alternate, as schematically shown with broken line stitching S in FIG. 7B. Sewn together in this fashion, the two pieces form the overall fabric cover 120 described above. With one end E of this fabric cover 120 sewn shut, plugged, or otherwise sealed off, the granular filler 118 can then be packed into the sewn-together cover 120 to impart the finished 3D bobble strand shape to the filled tubular cover 120, which is then sewn shut, plugged or otherwise sealed off at the other end to seal the granular filler inside.

This completes the construction of the headband's rear half 116, which can then be connected at its two opposing ends E to the two opposing ends of the headband's ornamental front half 114 by suitable connectors 122. Hook and loop fastener, snap fasteners or other releasable connectors may optionally be used, in which case the front and rear halves of the headband are selectively attachable and detachable to and from one another, for example to allow microwaved heating of the rear half 116 without the front half 114, and/or to allow interchange of a variety of differently-configured front halves to impart a different ornamental aesthetic to the front of the headband 112 (e.g. different auxiliary hair colours, differently braided auxiliary hair, differently patterned/jeweled chains, etc.). The use of stretchable fabric for the outer cover 120 is preferred so that longitudinal stretchability of the rear half 116 of the headband enables enlargement of the overall closed-loop shape of the headband to allow the headband to stretch over the top of the user's head into the working position, whereupon the resiliency of the outer cover 120 will self-tighten the headband 12 into secured circumferential relation to the user's head.

In an alternate construction option for the granularly filled embodiment of FIG. 2, a one-piece tubular fabric cover of stretchy material with an initially uniform and unstretched diameter may alternatively be used, with the granular filler being packed thereinto in sequential volumes of alternating size, with the tubular cover being pinched off and sewn into a closed, or at least constricted, state between such deposits. The larger volume deposits are packed in at a higher linear density in the axial direction so as to stretch the fabric radially outward from its relaxed default diameter, thus creating the enlarged rounded bobbles 116A where the fabric is overpacked and stretched in this manner. The fabric is then pinched and sewn into a closed or constricted state immediately beside this large deposit, whereafter a smaller deposit of granular material is made beside the previously placed large deposit, but is packed at a lesser linear density that doesn't stretch the fabric, at least not as much, from its relaxed default diameter, thus creating the smaller neck beside 116B the previously formed bobble 116A. This smaller volume is then pinched off and sewn, and then this two-step filling process repeated until the stretchable tubular fabric is entirely filled from end to end with alternating large and small deposits, creating the alternating pattern of enlarged bobbles 116A and reduced necks 116B.

The embodiment of FIG. 3 does not use a granular filler 118 to impart the bobble strand shape to the outer fabric cover of the headband's rear half. Instead, this embodiment uses a molded flexible insert 118' made of foam, rubber or other flexible material that embodies the alternating bobbles 116A and necks 116B of the headband's rear half. As shown, a fabric outer cover 120' may once again be provided in shrouding relationship around this molded flexible insert 118' so that the exterior surfaces of the headband's rear have a more suitable tactile character that the foam, rubber or other flexible material of the insert 118'. The cover 120' is shown as being a sheer fabric through which the insert 118' can be seen for visual appreciation of the form and construction of the illustrated embodiment. In practice however, it will be appreciated that the cover 120' may be made of opaque fabric that visually conceals the insert 118' from the user's sight. The insert is flexible via bending action at the reduced diameter necks 1166 thereof to change to the degree of arc-like curvature possessed by the bobble strand axis A. This way, when the headband is worn in stretched or tight-fitting state around the user's head, the bobble strand will arch across the back of the user's head in generally conforming relationship thereto, as opposed to having a fixed linear or arched shape that may stick out from the user's head.

The outer fabric cover 120' may or may not be designed to fit in snugly conforming fashion against the exterior surfaces of the molded flexible insert 118'. The illustrated example in FIG. 3 shows a loose-fitting non-fabric cover 120' that doesn't self-conform to the bobble strand shape of the insert 118', as shown by the annular clearance space C between the cover's interior surface and the reduced-diameter necks 116B of the flexible insert 118'. That being said, wrapping of the air around the outer cover 120' during use of the appliance will collapse the neck-overlying areas of the non-conforming cover 120' inwardly against the reduced diameter necks 116B of the insert 118'. Alternatively, a form-fitting cover of self-conforming shape to the insert 118' may be used, for example in the form of a stretchable sleeve of fabric whose default relaxed diameter is less than the diameter of the bobbles 116A, and is less than or equal to the diameter of the necks 116B, whereby the bobbles 116A will locally stretch the fabric sleeve at the areas thereof occupied by the bobbles, to whose shape the stretched fabric will conform. Alternatively, a two-piece cover 120 of the type described in relation to FIGS. 2 and 7 may be assembled from stretchable fabric, and then slipped over the flexible insert 118'.

Figure 8:
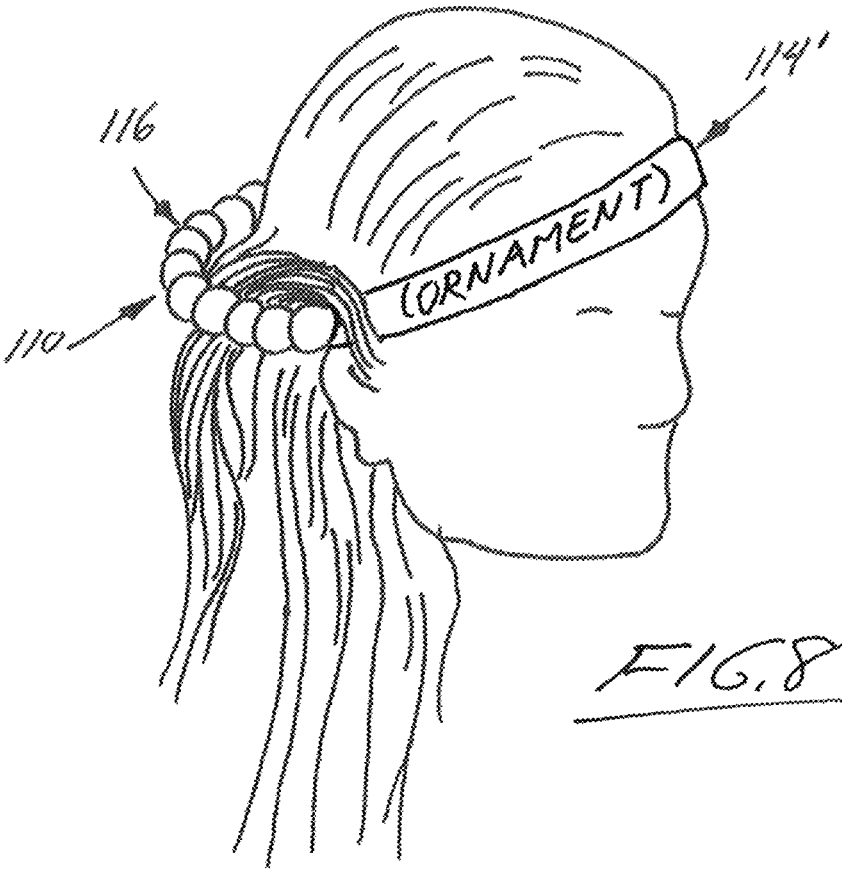
FIG. 8 is similar to FIG. 4, but illustrating an embodiment in which the braided or jeweled front portion of the headband shown in the other figures, is replaced with an ornamented fabric band.

With reference to FIG. 8, as an alternative to ornamental braids, chains or other strung jewelry at the front half of the headband, a simple band of fabric 114' may span between the two ends of the rear tubular cover at the front of headband, and may carry one or more gems thereon, and/or have a printed or natural ornamental pattern thereon for aesthetic purposes for wearing out of the appliance in social settings. Other variations may omit ornamental aspects altogether and just use a plain fabric band for the front half for more conventional "overnight" use, where the appliance is not worn out of the house in social settings. This band may be resiliently stretchable, and thus contribute to the self-fitting self-securing resiliency of the overall headband, or, less preferably, may be made of a non-stretchable fabric. Cotton and spandex are just two examples of a large variety of fabrics that may be employed for use in an ornamented or non-ornamented fabric band at the front half of the headband.

By replacing the generally cylindrical rear roller of Applicant's earlier designs in FIGS. 1A-1C with a bobble-strand configuration of enlarged ball-shaped bobbles with reduced necks interspersed therebetween, the novel hairstyling headbands of the present invention imparts a notably different style of curl to the user's natural hair, and more particularly a style curl that, at least in the opinion of some, is superior to those of the type that are formed by Applicant's earlier design, and/or by the other wearable hairstyling appliances referred to in the background above.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A hair styling device comprising:

a headband wearable in a working position lying along a hairline of a user's head to span around a crown of the user's head with a front portion of the headband spanning generally across a forehead of the user's head and a rear portion of the headband spanning across a back of the user's head behind the ears thereof;

wherein:

the front portion of the headband comprises one of the following:

an ornamental braid comprising a cluster of natural or synthetic hair configured in a braided pattern; or one or more jewelry chains;

the rear portion of the headband comprises a bobble strand comprising a series of ball-shaped bobbles sequentially arranged along said strand, in an axial direction thereof denoted by a strand axis penetrating through said ball-shaped bobbles, in alternating fashion to a series of reduced-diameter necks that are interspersed between said ball-shaped bobbles in said axial direction and are also penetrated by said strand axis, among which each individual one of the ball-shaped bobbles and each individual one of the reduced diameter necks has a three-dimensionally convex shape, and the reduced diameter necks are of lesser diameter, measured radially of said strand axis, than said ball-shaped bobbles, whereby the alternating ball-shaped bobbles and reduced diameter necks are wearable to span in series across the back of the user's head, where the user's hair is able to be wrapped around the three dimensionally convex shape of said each individual one of the ball-shaped bobbles and said each individual one of the reduced-diameter necks at a rear of the hairline to impart a curling action that leaves behind a curled hairstyle on the user's hair when the headband is removed; and the three dimensionally convex shape of said each individual one of the ball-shaped bobbles and said each individual one of the reduced-diameter necks includes a full 360-degree circumferential convexity around said strand axis; and the bobble strand is further characterized by at least one of the following features:

(a) the three-dimensionally convex shape of said each individual one of the reduced-diameter necks is externally ovoid or spherical;

(b) the three-dimensionally convex shape of said each individual one of the ball-shaped bobbles and said each individual one of the reduced diameter necks also has an axial convexity along the strand axis, and the axial convexity of each of the reduced-diameter necks intersects with the axial convexities of a neighboring two of the ball-shaped bobbles where said reduced-diameter neck joins said neighboring two of the ball-shaped bobbles; and (c) the ball-shaped bobbles and the reduced diameter necks are embodied as integrally interconnected elements of a singular unitary body contained within a fabric cover of loose-fitting non-conforming relation to the singular unitary body.

2. The device of claim 1 wherein the bobble strand is characterized by at least one of either feature (a) or feature (b), each ball-shaped bobble and each reduced-diameter neck comprises a respective ball-shaped volume of granular material contained within a fabric cover of the bobble strand, and said fabric cover comprises two sheets of fabric each shaped in a bobble pattern having wider areas that coincide with the ball-shaped bobbles and narrower areas that are interspersed between the wider areas and coincide with the reduced diameter necks, and said two sheets of fabric are seamed together along aligned boundary edges of both the wider and narrower areas thereof.

3. The device of claim 1 wherein the bobble strand is characterized by at least one of either feature (a) or feature (b), and each ball-shaped bobble and each reduced-diameter neck comprises a respective ball-shaped deposit of granular material contained within a fabric cover of the bobble strand that is composed of stretchable material and is pinched off in a closed or constrained state between each adjacent pair of said ball-shaped deposits.

4. The device of claim 1 wherein each bobble comprises a respective ball-shaped volume of foam material and each reduced-diameter neck comprises a respective smaller volume of foam material of lesser size than the ball-shaped volume.

5. The device of claim 4 wherein the bobble strand is characterized by at least feature (c), and the singular unitary body is composed of said foam material.

6. The device of claim 1 wherein the bobble strand is characterized by at least feature (c).

7. The device of claim 4 wherein the bobble strand comprises the fabric cover which is stretchable and in which said foam is contained, and which is characterized by a relaxed diameter of lesser diametrical measure than each ball-shaped volume of foam material.

8. The device of claim 7 wherein said relaxed diameter is also of lesser diametrical measure than each smaller volume of foam material.

9. The device of claim 4 wherein the bobble strand is characterized by at least one of either feature (a) or feature (b), and the bobble strand comprises a stretchable fabric outer cover that comprises two sheets of fabric each shaped in a bobble pattern having wider areas that coincide with the ball-shaped bobbles and narrower areas that are interspersed between the wider areas and coincide with the reduced diameter necks, and said two sheets of fabric are seamed together along aligned boundary edges thereof.

10. The device of claim 1 wherein the bobble strand is characterized by at least feature (b).

11. The device of claim 1 wherein the bobble strand is characterized by at least feature (a).

12. The device of claim 11 wherein the three-dimensionally convex shape of said each individual one of the reduced diameter necks is externally ovoid.

13. The device of claim 10 wherein the bobble strand is also characterized by feature (a).

14. The device of claim 11 wherein the three-dimensionally convex shape of said each individual one of the reduced diameter necks is externally spherical.

15. The device of claim 1 wherein said front portion of the headband comprises said ornamental braid.

16. The device of claim 15 wherein said front portion of the headband further comprises one or more hair clips operable to attach the natural or synthetic hair of said ornamental braid to the user's hair along a front hairline thereof.

17. The device of claim 1 wherein said front portion of the headband comprises said one or more jewelry chains.

18. The device of claim 17 wherein said front portion of the headband comprises one or more ornamental jewels attached to at least one of said one or more jewelry chains.

* * * * *